United States Patent [19]

Grossmann

[11] Patent Number: 4,915,143

[45] Date of Patent: Apr. 10, 1990

[54] SELECTIVELY FEEDING ONE OF A PLURALITY OF WEFT THREADS TO A GRIPPER PROJECTILE

[75] Inventor: Hans Grossmann, Heidenheim, Fed. Rep. of Germany

[73] Assignee: Hermann Wangner GmbH & Co. KG, Reutlingen, Fed. Rep. of Germany

[21] Appl. No.: 324,112

[22] Filed: Mar. 16, 1989

[30] Foreign Application Priority Data

Mar. 16, 1988 [DE] Fed. Rep. of Germany ..... 3808777

[51] Int. Cl.[4] ..... D03D 47/24

[52] U.S. Cl. ..... 139/438; 139/443; 139/453

[58] Field of Search ..... 139/437, 443, 438, 439, 139/, 446, 448, 453

[56] References Cited

U.S. PATENT DOCUMENTS 4,098,300 7/1978 Mollica ..... 139/437
4,259,996 4/1981 Mollica ..... 139/437

FOREIGN PATENT DOCUMENTS 119393 1/1984 European Pat. Off. .
1535670 1/1973 Fed. Rep. of Germany .
1130892 10/1968 United Kingdom ..... 139/125

*Primary Examiner*—Andrew M. Falik
*Attorney, Agent, or Firm*—Sughrue, Mion, Zin, Macpeak & Seas

[57] ABSTRACT

An apparatus for the selective feeding of one of a plurality of weft threads (1) to a gripper projectile, which moves along a projectile path (2), includes a plurality of displaceable feeders (3) each having a feeder clamp (7) for retaining a respective weft thread (1) in position for pick up, a knife (4) for cutting off the weft thread (1) after it has been drawn into the weaving shed by the gripper projectile, and a clamp for picking up the weft thread (1) from a feeder and drawing the weft thread (1) transversely across the projectile path (2) for engagement by the gripper projectile. The clamp is mounted on a rotatable ring (6) which is disposed perpendicular to the projectile path (2) which extends through the ring.

4 Claims, 4 Drawing Sheets

SELECTIVELY FEEDING ONE OF A PLURALITY OF WEFT THREADS TO A GRIPPER PROJECTILE

BACKGROUND OF THE INVENTION

The invention relates to an apparatus for the selective supply of one of a plurality of weft threads to a gripper projectile, which moves along a projectile path. The apparatus includes a plurality of displaceable feeder means, which keep the individual weft threads ready and comprise a feeder means clamp for retaining the particular weft thread. The gripper projectile draws the weft threads into the weaving shed, and the weft threads are subsequently cut off by a knife. The weft thread kept ready by a feeder is retained by a clamping means and spanned transversely across the projectile path.

An apparatus of that type is known from EP-A-119,393. The clamping means in that regard is stationary and has two clamping jaws which may be closed. The feeders are displaceable in their longitudinal direction and supply the weft thread, which is to be drawn in, to the clamping jaws, in which respect they extend from below through an apertured cutter plate over the projectile path. Collisions may on account of that occur between the gripper projectile and the feeders. Malfunction of the cylinder-piston-aggregate at a moment when a thread feeder is disposed in an advanced position may lead to damage to the thread feeder or the knives. In the known apparatus, the weft threads are cut by the knives when the thread feeders are in retracted position. As a result, a thread end projects freely beyond the thread feeders which end must be threaded through the hole when the thread feeder performs an outward run. If the weft thread is unstable, it bends laterally and cannot be grasped by the clamping device. Furthermore, it has turned out in practice that the device known from EP-A-119 393 can, on account of the way the movement thereof runs off, only be actuated by pneumatic or hydraulic working elements. As a result, the working speed is limited to approximately 70 cycles/min.

An apparatus for the selective supply of one of a plurality of weft threads to a gripper projectile is known from DE-AS-1 535 670, in which the various weft threads may be moved by means of displaceable thread guides into a position, from which they are spanned over the path of the gripper projectile by means of a finger, which is pivotably attached to the edge of a rotatable disc that is located next to the projectile path. The known weft thread supply device is positioned directly adjacent the selvedge for the thread impact to be as far as possible balanced out, which would be caused by the loop drawn by the thread feeder and would mean that acceleration would be interrupted.

SUMMARY OF THE INVENTION

The invention is based on the problem of providing an apparatus for selectively making available one of a plurality of weft threads for take-over by the gripper projectile, which works reliably and largely free from disturbance in a mechanical force-controlled manner at a high operating speed (up to at least 160 cycles/min.).

This problem is solved according to the invention in that the clamping means is a rotating ring, which comprises a ring clamp and is arranged in a manner such that the imagined extension of the projectile path passes through the ring, the ring clamp taking over the weft filament from a feeder and upon its circular movement spanning it transversely over the projectile path, so that the weft thread can be grasped by the gripper projectile.

The basic idea in that regard resides in avoiding having the feeder cross the path of the gripper projectile. In that case of the apparatus of the invention, the feeders are merely swiveled to the transfer position, at which the ring clamp then takes over the weft thread. That kind of set-up can be mechanically force-controlled in a simple manner.

The ring preferably includes two ring clamps, which are arranged on opposite sides of the ring and offset by 180°. In that regard, each ring clamp has its own feeder battery. The advantage provided for in the case of this embodiment is that the ring needs to only still turn by 180° per pick. The course of the movement hence slows down, so that there is substantially more time available for changing feeders. It is, however, not possible to supply a weft thread twice in succession from the same feeder. Hence, the weft thread must be taken, constantly alternating, off the one feeder battery and then off the other feeder battery.

There also exists the possibility of arranging several rings with respectively one or two ring clamps behind one another. In that way, the number of weft threads that may be selectively supplied can be increased almost as desired.

The weft thread supply device according to the invention operates with laterally pivotable feeders being employed, which comprise a tube through which the weft thread runs and which comprises a feeder clamp securely connected to the feeder at an axial spacing from the outlet end of the tube, the feeder clamp being adapted to be opened in a mechanical force-controlled, hydraulic, pneumatic or electric manner.

The knife consists of two knife blades which are relatively displaceable and disposed one above the other, which have a recess open to one side, in which a thread which has been placed therein may be sheared off through relative displacement of the two knife blades. Transfer of the weft thread form the feeder to the ring clamp occurs when said clamp is located at the uppermost point of circular movement. At the position which is diametrically opposite the transfer position, a pin extends through the ring, which serves for precisely positioning and drawing taut the weft thread for take-over by the gripper projectile.

In the first operating step (ring clamp at the transfer position) the ring clamp, which may be designed, for instance, as a clamping wedge, grasps the weft thread drawn taut between the feeder tube and feeder clamp.

In the second operating step (ring clamp directly subsequent to the transfer position) the ring clamp draws the weft thread out of the feeder clamp and takes it along downwardly. The feeder clamp will be opened after the weft thread has been drawn out of the feeder clamp.

In the third operating step (ring clamp just prior to the position 180° after the transfer position) the ring clamp places the weft thread into the opening of the knife and into the opened feeder clamp.

In the fourth operating step (ring clamp at 180° subsequent to the transfer position) the ring clamp moves through underneath the pin, positions and pulls taut the weft thread between the feeder and the pin, so that the weft thread is ready for being pulled-off by the gripper projectile.

In the fifth operating step the gripper projectile draws the weft thread into the weaving shed. At the end of draw-in, the feeder clamp closes again and clamps the weft thread. Thereafter the weft thread is cut off by the knife.

In the sixth operating step the feeder is changed.

BRIEF DESCRIPTION OF THE DRAWINGS

Illustrative embodiments of the invention shall be explained by way of the drawings, in which.

DETAILED DESCRIPTION OF THE INVENTION

Figure 3:
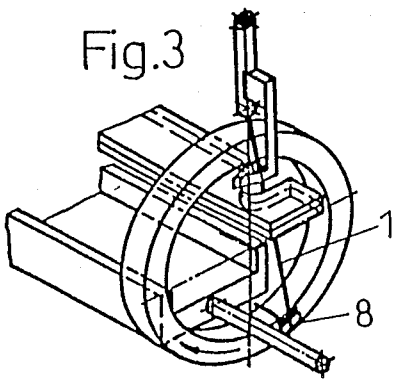
FIG. 1 to 6 depict the various operating steps upon the supply of a weft thread, the apparatus being shown in a view obliquely from the top and from the center of the weaving machine outwardly.
Figure 6:
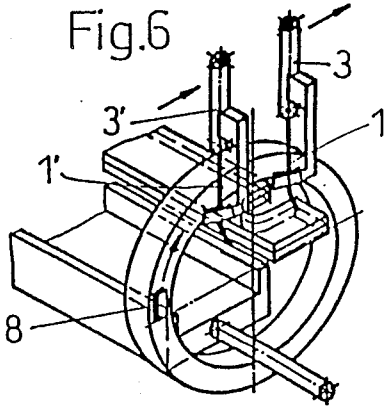
Figure 2:
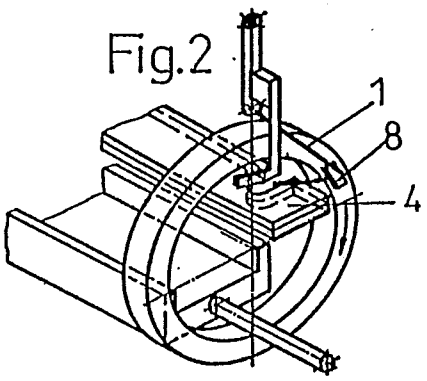
Figure 5:
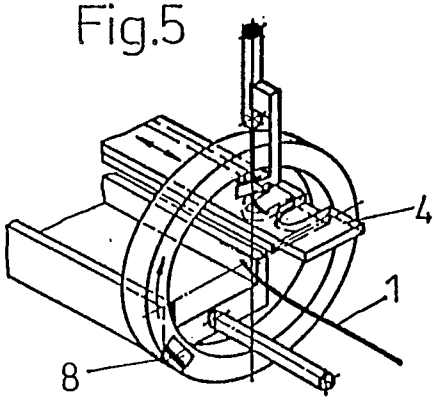
Figure 4:
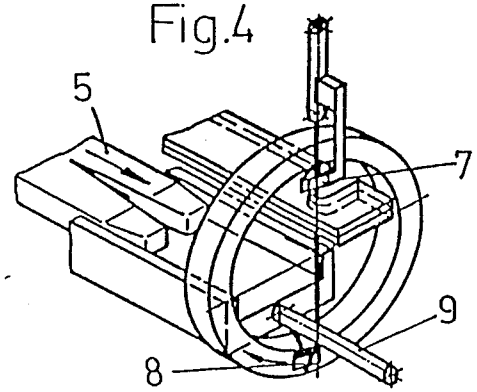

In the illustrated embodiment of FIG. 1 to 6, a gripper projectile 5 is shot into the weaving shed in the direction indicated by an arrow in FIG. 4 along a projectile path 2. The part of the projectile path 2 that is shown is still part of the pick motion which is not shown. The projectile path 2 merges into the weaving shed which likewise is not shown. The apparatus for the selective supply of one of a plurality of weft threads 1 to the gripper projectile 5 is disposed between the pick motion and the weaving shed. The apparatus includes a rotatably mounted ring 6, which carries a ring clamp 8 on one side. The ring 6 is disposed in a vertical plane and rotates in this plane, which is located perpendicularly to the direction of movement of the gripper projectile 5. Ring 6 is arranged in a manner such that the imagined extension of the projectile path 2 leads through the inside of ring 6, so that the gripper projectile 5 travels through the ring 6.

Figure 10:
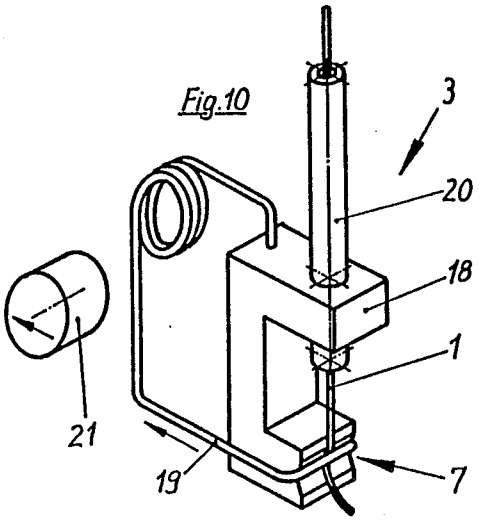
FIG. 9 and 10 depict a feeder with opened or, resp., closed feeder pin.
Figure 9:
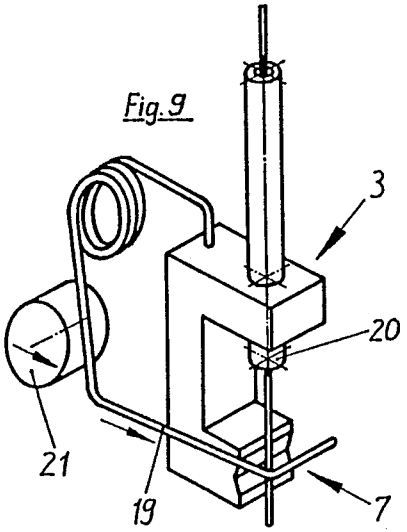

Adjacent the rim of ring 6 there is arranged a battery of feeders 3, with only one of these feeders 3 being shown in FIGS. 1 to 5. Feeder 3 comprises a tube 20, through which the weft thread 1 runs. At the end of the tube 20 a feeder clamp 7 is retained at an axial spacing from the end of the tube 20 by means of a laterally offset clip. The feeder clamp 7 includes a hardened steel body 18, on the lower end of which a V-shaped notch is located. A biased spring steel wire 19 is disposed within said notch, see FIG. 10. The weft thread 1 is clamped between steel body 18 and spring steel wire 19. If the feeder clamp 7 is to be opened, a roller 21 is urged against the spring steel wire 19 in the direction of the arrow (FIG. 9). When the roller 21 is raised from the spring steel wire 19, the feeder clamp 7 has closed (FIG. 10). The weft thread 1 is pulled taut between the tube 20 of feeder 3 and the V-shaped notch of feeder clamp 7 and can in this region be grasped by ring clamp 8.

The feeder clamp 7 is actuable, so that the weft thread 1 can be reinserted after it has been pulled out by the ring clamp. The feeder 3 is adapted to be pushed or swiveled into a transfer position, in which the end of the tube and the feeder clamp 7 are disposed in the proximity of the uppermost point of ring 6, so that the ring clamp 8 is able to grasp the piece of weft thread 1, which is located between the end of the tube and the feeder clamp 7, at the uppermost point of its circular motion. The ring clamp 8 may in that respect be a pin, wedge or hook projecting from ring 6 at a small angle.

A knife 4, which consists of a stationary knife plate **4*a* and a displaceable knife plate 4*b* having a lateral opening 22, extends through the ring. A thread placed into this opening 22 may be sheared off through displacement of the knife plate 4*b*. The knife 4 is arranged in a manner such that the opening 22 is disposed in the plane of the circular motion of the ring clamp 8, viz. such that the thread grasped by the ring clamp 8 and pulled out of the end of the tube 20 is inserted into this opening 22** subsequently to a rotation of less than 180°.

At the location diametrically opposite to the transfer position, a pin 9 extends from the end of the projectile path 2 through the interior of ring 6.

Figure 8:
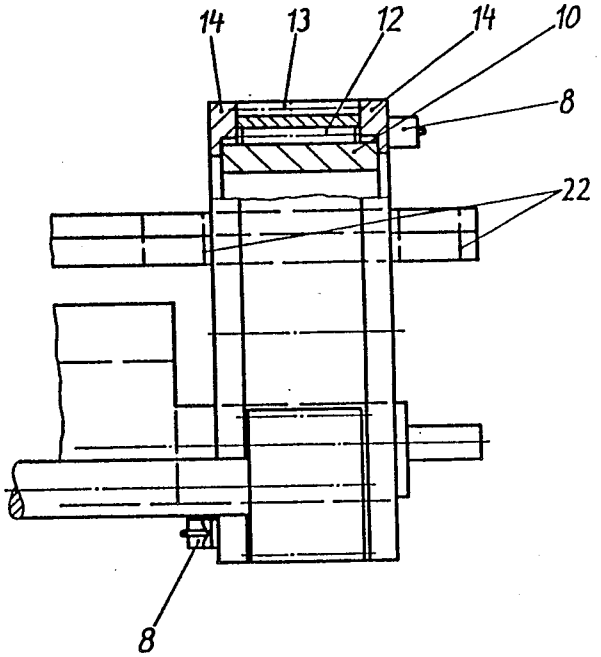
FIG. 7 and 8 depict the rotatably mounted ring in view from the front or from the side.
Figure 7:
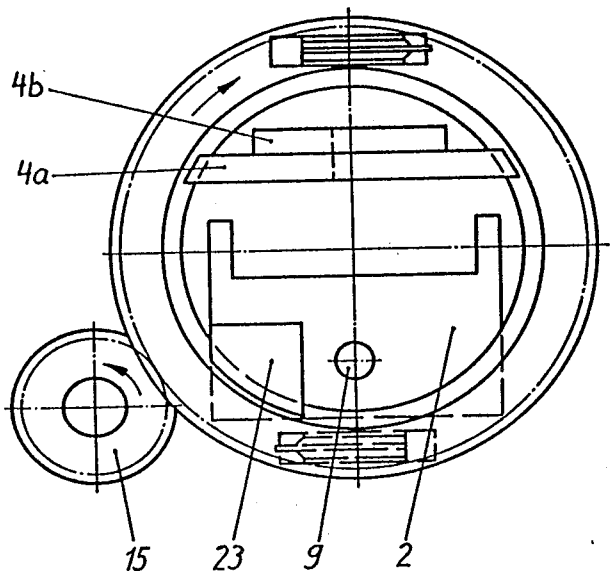
Figure 11:
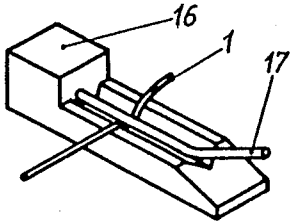
FIG. 11 depicts the ring clamp.

FIG. 7, 8 and 11 depict details of the rotatably mounted ring 6 and the ring clamp 8. The rotatably mounted ring 6 consists of a needle bearing 12 and a gear wheel 13 attached thereto. It runs on a needle bearing—inner race 10, which is held by the stationary knife plate **4*a* and by a finger 23 projecting from the projectile path 2. Two guide rings 14 are attached laterally to the gear wheel 13, the guide rings sliding laterally along the needle bearing inner race 10 and in that way providing axial guidance for the rotatably mounted ring 6. Guide rings 14 are expediently made of brass. The rotatably mounted ring 6 is driven by a drive gear wheel 15, which engages into gear wheel 13**.

One or more ring clamps is (are) attached to the guide rings 14. The ring clamp 8 consists of a hardened steel body 16 having a V-shaped notch, in which a biased spring steel wire 17 is disposed, see FIG. 11. The weft thread is clamped between the steel body 16 and the spring steel wire 17. Swiveling of the individual feeders 3 into the transfer position and out of said position takes place by means of cam gears, such as they are generally known and therefore are not being described in greater detail here. In the same way, the control of roller 21, which engages the spring steel wire 19 of feeder clamp 7, takes place by means of a cam gear. Both cam gears are controlled by the main shaft of the weaving machine in time with the remaining elements of the weaving machine. Control of the feeders 3 and of the roller 21 may also take place by means of electric, pneumatic or such like setting elements.

Figure 1:
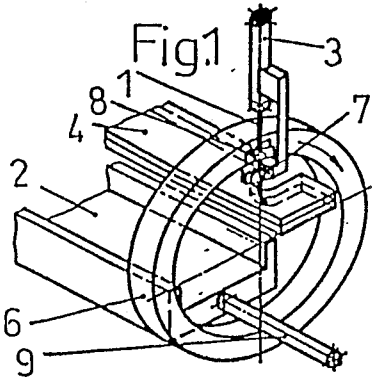

Transfer of a weft thread 1 occurs in a manner such that, as shown in FIG. 1, the ring clamp 8 grasps at the transfer position the weft thread 1 that is presented by the feeder 3. As it continues to move, the ring clamp 8 draws the weft thread 1 out of the feeder clamp 7 and takes the weft thread 1 along in its circular motion, see FIG. 2.

Feeder 3 at first does not change its position and the ring clamp 8 inserts, in the course of its continued circular motion, the weft thread 1 into the opening 22 of the knife 4 and into the opened feeder clamp 7 see FIG. 3. In the position shown in FIG. 4, the ring clamp 8 has carried out a circular motion of about 180°. The longitudinal axis of the feeder 3 extends in the direction of the diameter of ring 6, so that the ring clamp 8, as it moves 180° from the transfer position, pulls the weft thread from the end of the tube 20 through the opened feeder clamp 7, through the opening 22 of knife 4 and past the pin 9. As it continues to move, the ring clamp 8 pulls the weft thread 1 taut and positions it between the feeder 3 and the pin 9, and in this position, the weft thread 1 can be drawn off by the gripper projectile 5, see FIG. 4. The weft thread 1 is pulled by the gripper projectile 5 out of the ring clamp 8 and is now drawn into the weaving shed. As soon as the gripper projectile 5 has drawn the weft thread 1 in through the entire weaving shed, the feeder clamp 7 is closed and thereafter the thread 1 is sheared off by knife 4, see FIG. 5. Meanwhile, the ring clamp 8 has carried out a portion of the second half of a complete circular motion, and during this portion of the circular motion the feeder 3 may be exchanged, in order to draw another weft thread 1' into the weaving shed the next time a thread is shot in. To that end, the feeder 3 is swiveled away, and another feeder 3' is swiveled into the transfer position, see FIG. 6.

Expediently, the transfer position is disposed at the uppermost point of the circular motion of the ring clamp 8. Depending upon the time spans available, a different position, for instance a position shifted clockwise in FIGS. 1 to 6, may be chosen so as to have more time available for exchanging the feeders 3,3'. The ring 6 may also be positioned in a manner slightly offset laterally relative to the projectile path 2, as long as it is made certain that the gripper projectile 5 can travel unobstructed through the ring 6.

In the illustrative embodiment according to FIG. 1 to 6, a single rotatably mounted ring 6 with a ring clamp 8 is provided. In the case of the rotatable ring shown in detail in FIG. 7 and 8, two ring clamps 8 are provided, resp. a ring clamp 8 each on each of the guide rings 14. The two ring clamps 8 are in that regard arranged to be offset by 180° relative to one another. Accordingly, the knife 4 has two openings 22, respectively one opening 22 being located within the plane of the circular motion of the two ring clamps 8.

Figure 13:
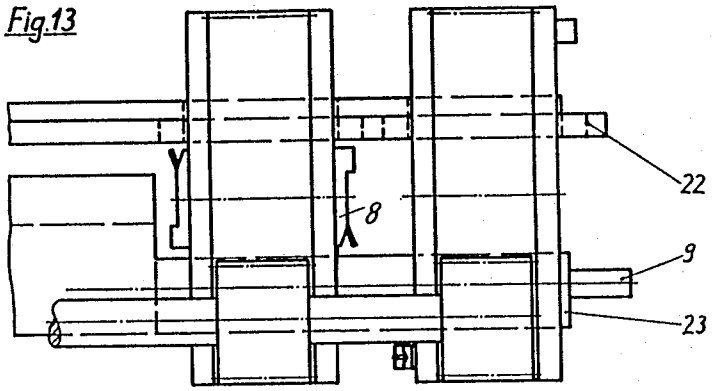
FIG. 13 shows a side view of the two rotatably mounted rings according to FIG. 12.
Figure 14:
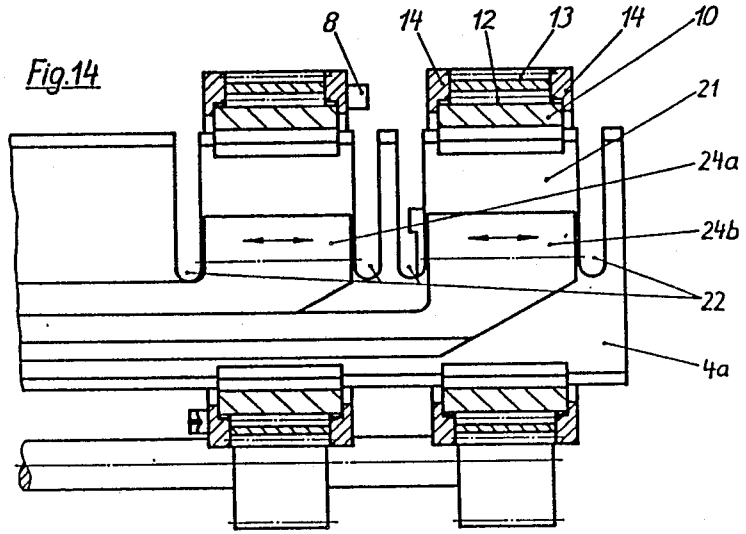
FIG. 14 shows from the top the two rotatably mounted rings of FIG. 12, the rotatably mounted rings being shown in section so as to make the knife visible.
Figure 12:
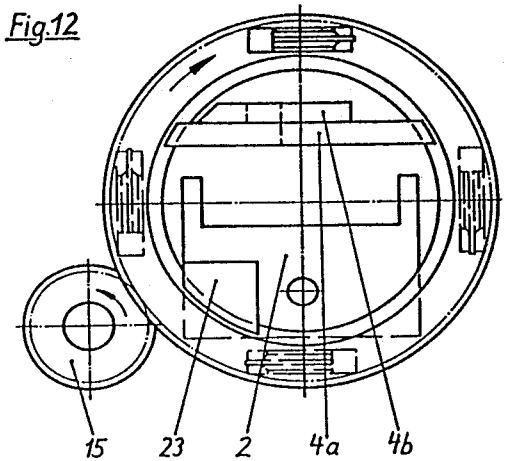
FIG. 12 depicts from the front an embodiment with two rotatably mounted rings.

FIGS. 12 to 14 depict an illustrative embodiment with two rotatably mounted rings 6. The mounting and drive means are designed such as shown in FIG. 7 and 8. Each ring 6 has two ring clamps 8, which again are supported by respectively one of the guide rings 14 and are relatively offset by 180°. The two rings 6 are again relatively offset by 90°, so that the in all four ring clamps 8 are offset by 90° one relative to the other. Finger 23 and the stationary knife plate **4*a* are extended such that they lead through the two rotatable rings 6 and support these. On the lower, stationary knife plate 4*a* there are disposed two adjacent, displaceable knife plates 24*a*, 24*b*, which are separately controllable, and four openings 22 are provided in the knife, in which the weft thread 1 can be sheared off through displacement of respectively one of the two displaceable knife plates 24*a* or, reps. 24*b* in one of the two directions. If a weft thread 1 has been placed by a ring clamp 8 in one of the openings 22 of the knife 4 and inserted into the weaving shed, it is cut off in that the cutting edge of the displaceable knife plates 24*a*, 24*b*, which cutting edge is facing the opening 22, is pulled across the opening 22. Each one of the displaceable knife plates 24*a*, 24*b* has for that purpose two cutting edges, which are facing the openings 22**.

There may, correspondingly, also be provided three or more rotatably mounted rings 6, each ring 6 being able to include one or two ring clamps 8. There may in that regard be associated one or more feeders 3 with each ring clamp 8.

What is Claimed:

1. An apparatus for selectively feeding one of a plurality of weft threads (1) to a gripper projectile (5), which moves along a projectile path (2), comprising a plurality of displaceable feed means (3) each of which is adapted to supply one weft thread (1) and includes a feed means clamp (7) for retaining said weft thread (1) in position for pick up, knife means (4) for cutting said weft thread (1) after it has been drawn into a weaving shed by said gripper projectile (5), and clamping means for picking up and retaining the weft thread (1) from said feed means (3) and for extending the weft thread (1) transversely across the projectile path (2) until it is grasped by said gripper projectile (5), wherein said clamping means is comprised of a rotatably mounted ring (6) having a ring clamp (8) mounted thereon and disposed in a plane perpendicular to said projectile path (2) which extends through said ring whereby upon rotation of said ring the ring clamp will pick up the weft thread (1) released by said feed means clamp (7) and draw the thread transversely across said projectile path (2).

2. The apparatus of claim 1 further comprising a pin (9), which is arranged to be mounted stationary diametrically opposite said feed means (3) about which the thread is tensioned and positioned for pick up by said gripper projectile.

3. The apparatus of claim 2 wherein said knife means extends through said ring and is provided with notch means into which said thread is laid when positioned between said feed means and said pin whereby said thread can be severed by said knife means subsequent to projection of the thread through said weaving shed by said gripper projectile.

4. The apparatus of any one of claims 1 to 3 wherein a plurality of rings (6) are arranged.

* * * * *